US008770938B2

(12) United States Patent
Kreiselmaier et al.

(10) Patent No.: US 8,770,938 B2
(45) Date of Patent: Jul. 8, 2014

(54) ROTOR FOR AN AXIAL-THROUGHFLOW TURBOMACHINE AND MOVING BLADE FOR SUCH A ROTOR

(75) Inventors: Erich Kreiselmaier, Stetten (CH); Kurt Rubischon, Lengnau (CH); Christoph Nagler, Zürich (CH); Herbert Brandl, Waldshut-Tiengen (DE)

(73) Assignee: Alstom Technology Ltd, Baden (CH)

( * ) Notice: Subject to any disclaimer, the term of this patent is extended or adjusted under 35 U.S.C. 154(b) by 789 days.

(21) Appl. No.: 12/942,565

(22) Filed: Nov. 9, 2010

(65) Prior Publication Data

US 2011/0110785 A1 May 12, 2011

(30) Foreign Application Priority Data

Nov. 10, 2009 (CH) ..... 1723/09
Nov. 10, 2009 (CH) ..... 1724/09

(51) Int. Cl.
*F01D 5/30* (2006.01)

(52) U.S. Cl.
USPC ..... 416/216; 416/221

(58) Field of Classification Search
USPC ..... 416/215, 220 R, 221 R, 216, 248, 221
See application file for complete search history.

(56) References Cited

U.S. PATENT DOCUMENTS 2,809,801 A * 10/1957 Curry ..... 416/216
3,584,971 A 6/1971 Ortolano
3,922,109 A * 11/1975 Hagen ..... 416/213 R
4,645,425 A 2/1987 Morrison, Jr.
5,018,271 A * 5/1991 Bailey et al. ..... 29/889.71
5,141,401 A * 8/1992 Juenger et al. ..... 416/219 R
5,282,720 A * 2/1994 Szpunar ..... 416/220 R
5,431,542 A * 7/1995 Weisse et al. ..... 416/219 R
5,580,218 A * 12/1996 Nguyen et al. ..... 416/215
6,102,664 A * 8/2000 Nguyen ..... 416/248
6,183,202 B1 * 2/2001 Ganshaw ..... 416/219 R
6,739,836 B2 * 5/2004 Pinzauti et al. ..... 416/219 R
6,773,234 B2 * 8/2004 Sinha et al. ..... 416/219 R
2001/0019697 A1 9/2001 Mueller et al.

(Continued)

FOREIGN PATENT DOCUMENTS

EP 0707135 A2 4/1996
EP 1130217 A1 9/2001

(Continued)

*Primary Examiner* — Ned Landrum
*Assistant Examiner* — Joshua R Beebe
(74) *Attorney, Agent, or Firm* — Buchanan Ingersoll & Rooney PC

(57) ABSTRACT

A rotor is provided for an axial-throughflow turbo machine, which carries a plurality of moving blades which are each pushed with a blade root into a rotor groove extending about the axis and are held. The blade root includes a hammer root with a hammerhead and is supported on radial stop faces of the rotor groove which lie further outward in the radial direction, against centrifugal forces acting on the moving blades, and are supported on axial stop faces lying further inward in the radial direction, against axial forces which act on the moving blade. The rotor groove has at its bottom, to reduce thermal stresses, an axially and radially widened bottom region with a continuously curved cross-sectional contour. In such a rotor, an advantageous adaptation of the blading is achieved by the blade root of the moving blades being adapted to the widened bottom region in the radial direction.

19 Claims, 4 Drawing Sheets

(56) References Cited

U.S. PATENT DOCUMENTS

| | | | | |
|---|---|---|---|---|
| 2002/0182081 | A1* | 12/2002 | Bachofner et al. | 416/220 R |
| 2006/0197400 | A1* | 9/2006 | De Simone et al. | 310/216 |
| 2006/0228216 | A1* | 10/2006 | Bachofner et al. | 416/215 |
| 2007/0207034 | A1* | 9/2007 | Nogami et al. | 416/219 R |
| 2008/0095632 | A1* | 4/2008 | Phipps | 416/219 R |
| 2009/0022595 | A1* | 1/2009 | Cosi | 416/223 A |
| 2009/0087316 | A1 | 4/2009 | Mueller | |
| 2009/0285690 | A1* | 11/2009 | Brown et al. | 416/219 R |

FOREIGN PATENT DOCUMENTS

| | | | |
|---|---|---|---|
| EP | 1253293 | A2 | 10/2002 |
| EP | 1703080 | A1 | 9/2006 |
| EP | 2045444 | A1 | 4/2009 |
| GB | 614678 | A | 12/1948 |
| GB | 674543 | A | 6/1952 |
| JP | 2005220825 | A | 8/2005 |
| WO | 2005054682 | A1 | 6/2005 |

* cited by examiner

ROTOR FOR AN AXIAL-THROUGHFLOW TURBOMACHINE AND MOVING BLADE FOR SUCH A ROTOR

FIELD OF INVENTION

The present invention relates to the technological field of axial-throughflow turbomachines. It refers to a rotor for an axial-throughflow turbomachine and to a moving blade for such a rotor.

BACKGROUND

Stationary gas turbines with a high power output have long been an essential component of power stations, especially combined-cycle power stations. FIG. 1 shows a perspective, partially sectional view of an example of such a gas turbine which is supplied by the Assignee of the present invention and is known by the type designation GT26®.

The gas turbine 10 of FIG. 1 is equipped with what is known as sequential combustion. It comprises a multistage compressor 12 which sucks in air via an air inlet 15 and compresses it. The compressed air is used, in a following first annular combustion chamber 14*a*, partially for the combustion of an injected fuel. The hot gas occurring flows through a first turbine 13*a* and then enters into a second combustion chamber 14*b* where the remaining air is employed for the combustion of a fuel which again is injected. The hot gas stream coming from the second combustion chamber 14*b* is expanded in a second turbine 13*b* so as to perform work and emerges from the gas turbine 10 through an exhaust gas outlet 16, in order to be discharged outward or, in a combined-cycle power station, in order to be used for the generation of steam.

The compressor 12 and the two turbines 13*a*, 13*b* have sets of moving blades which rotate about the axis 30 and which, together with guide vanes fastened to the surrounding stator, form the blading of the machine. All the moving blades are arranged on a common rotor 11 rotatable about the axis and are fastened releasably to the rotor shaft by means of rotor grooves provided for this purpose. Special attention is in this case devoted to the last stages 12*a* of the compressor 12 where the compressed air reaches temperatures of several hundred degrees Celsius.

It is known from the prior art (see, for example, WO-A1-2005/054682), according to FIG. 2, to provide the moving blades 12 of the last stages 12*a* of the compressor 12 with a blade root 18 designed as a hammerhead root and to push them with the blade root 18 into a rotor groove 19 extending about the axis and hold them there. The blade root 18 is supported on radial stop faces 25 of the rotor groove 19 which lie further outward in the radial direction, against centrifugal forces which act on the moving blade 17. Said blade root is likewise supported on axial stop faces 20 lying further inward in the radial direction, against axial forces which act on the moving blade 17. An undercut is in this case provided between each of the radial stop faces 25 and each of the axial stop faces 20. A spring 22 is provided at the bottom of the rotor groove 19 and fixes the moving blade 17 in the radial direction during assembly.

In the course of ongoing discussions about energy and the environment, there is the persistent desire to increase the power, efficiency, combustion temperature and/or mass throughflow of machines of this type. An increase in the power output can be achieved, inter alia, by improving the compressor.

An improvement in the gas turbine entails an increase in the mass throughflow through the compressor which leads to a higher gas temperature in the last compressor stages 12*a*. The up-to-date, progressive aerodynamic design of the blade leaves for the compressor requires greater axial chord lengths, this leading to a greater distance between the rotor grooves 19.

The two together give rise to markedly increased thermal stresses in the notches at the bottom of the rotor grooves in the rear compressor stages when the machine is being started, because the center of the rotor body is still at a low temperature (T1 in FIG. 2), whereas the outer region is already exposed to the high full-load temperature (T2 in FIG. 2), and therefore high thermal stresses occur in the material.

In another context, to be precise in moving blades of gas turbines with a dovetail-shaped blade root which bears against oblique stop faces in the rotor groove and because of the friction exerts shear forces on the side walls of the groove, it has been proposed to introduce fillets into the rotor groove below the stop faces in order to break down the friction-induced stresses (see U.S. Pat. No. 5,141,401). Here, however, thermal stresses do not play any part.

In connection with measures for reducing the stresses in the region of the rotor groove, EP-A1-1703080 repeats the critical influence of the cross-sectional contour of the groove upon the stress profile in the rotor. It is suggested there, in this connection, that the groove bottom be given an elliptical cross-sectional contour.

A rotor groove designed in this way has at its bottom, in order to reduce thermal stresses, an axially and radially widened bottom region 23 with a continuously curved cross-sectional contour which is distinguished by a large radius of curvature in the region of the mid-plane 33 and is designed to be mirror-symmetrical with respect to the mid-plane 33.

Should the design of the rotor root 18 of the moving blade 17 be preserved in the case of a rotor groove geometry modified in this way, the hammerhead of the blade root 18 according to FIG. 3 would have to be enlarged by the amount of the additional volume 24 illustrated by hatching, and this would lead to a marked increase in the mass of the moving blade 17 and therefore to a rise in the centrifugal forces acting on the rotor groove 21.

SUMMARY

In a first embodiment, the present disclosure is directed to a rotor for an axial-throughflow turbo machine. The rotor carries a plurality of moving blades which are pushed, in each case, with a blade root into a rotor groove extending about an axis and are held there. The blade root includes a hammer root with a hammerhead and is supported on radial stop faces of the rotor groove which lie further out in the radial direction, against centrifugal forces which act on the plurality of moving blades, and is supported on axial stop faces lying further inward in the radial direction, against axial forces which act on the plurality of moving blades. The rotor groove having at a bottom portion, in order to reduce thermal stresses, an axially and radially widened bottom region with a continuously curved cross-sectional contour. The blade root of the plurality of moving blades is adapted to the widened bottom region in a radial direction.

In another embodiment, the disclosure is directed to a moving blade (26) for the above rotor. The moving blade includes a blade root designed as a hammer root with a hammerhead. The blade root is extended in the radial direction below the hammerhead in order to bridge the radial widening of the widened bottom region of the rotor groove.

BRIEF DESCRIPTION OF THE DRAWINGS

The invention will be explained in more detail below by means of exemplary embodiments in conjunction with the drawing, in which.

DETAILED DESCRIPTION OF THE PREFERRED EMBODIMENTS

Introduction to the Embodiments

Figure 1:
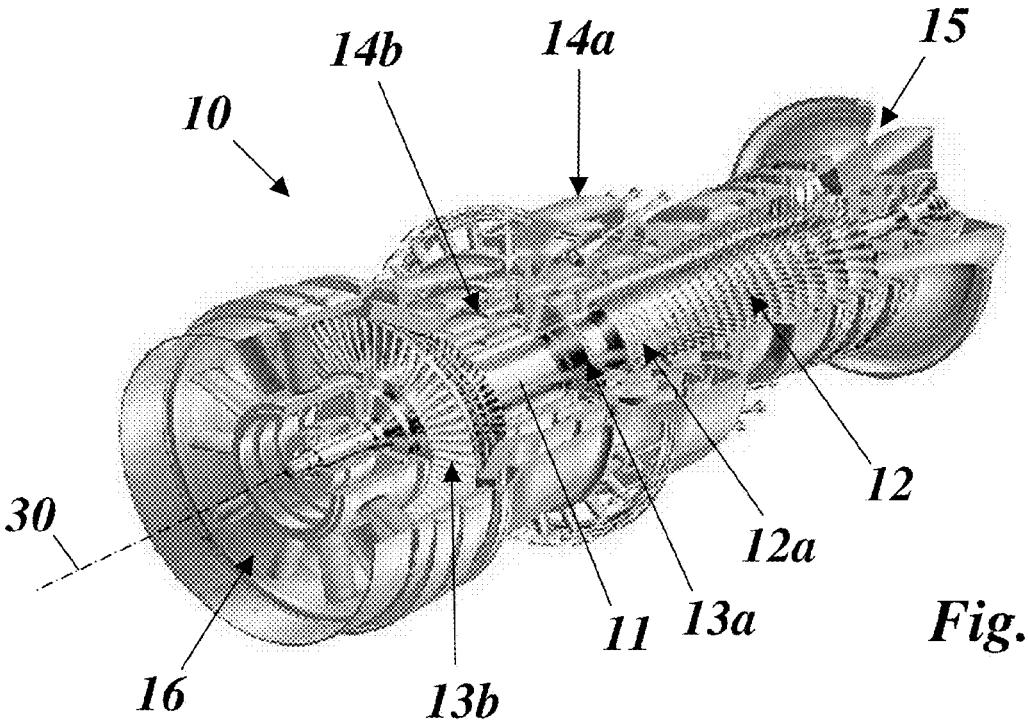
FIG. 1 shows a perspective, partially sectional view of a gas turbine with sequential combustion, such as is suitable for implementing the invention.

The object of the invention, therefore, is to design the rotor or the moving blades used on the rotor, such that the advantages of a rotor groove geometry with a widened bottom region and large radius of curvature can be exploited, preferably without disadvantages of any kind.

The object is achieved by the whole of the features as set forth in the appended claims. In the embodiments of the invention, the rotor groove has at its bottom, in order to reduce thermal stresses, an axially and radially widened bottom region with a continuously curved cross-sectional contour, and the blade root of the moving blades is adapted in the radial direction to the widened bottom region.

According to one embodiment of the invention, the widened bottom region is formed mirror-symmetrically to a mid-plane passing through a rotor groove and standing perpendicularly to the axis, and the radius of curvature of the cross-sectional contour of the bottom region in this case decreases from the mid-plane towards the margin.

Another embodiment of the invention is distinguished in that the widened bottom region has a predetermined maximum width in the axial direction, in that the radial stop faces have a predetermined minimum spacing in the axial direction, and in that the ratio of the minimum spacing to the maximum width amounts to between 0.1 and 0.6, that is to say $0.1<d_5/d_1<0.6$.

It is in this case advantageous if the widened bottom region has a predetermined first maximum depth in relation to the radial stop faces, the widened bottom region has a predetermined second maximum depth in relation to the inner edges of the axial stop faces, and the ratio of the second maximum depth to the first maximum depth amounts to between 0.4 and 0.9, that is to say $0.4<d_3/d_4<0.9$.

It is especially beneficial if a plurality of identical rotor grooves are provided, offset at a predetermined distance, in the axial direction, and the ratio of the maximum width to the distance amounts to between 0.5 and 0.8, that is to say $0.5<d_1/d_2<0.8$.

According to a further embodiment of the invention, the blade root is lengthened in the radial direction below the hammerhead in order to bridge the radial widening of the widened bottom region.

Preferably, to lengthen the blade root, a lengthening bolt extending radially is provided. The comparatively slender lengthening bolt bridges the distance, without any mass being needlessly added to the moving blade.

It is in this case advantageous in production terms if the lengthening bolt is integrally formed on the hammerhead.

Furthermore, it is advantageous if a curved transitional face is provided at the transition between the lengthening bolt and the hammerhead in order to ensure a continuous transition.

Alternatively, there may be provision for producing the lengthening bolt as a separate part and for connecting this to the hammerhead.

It is proved advantageous, in this case, to fasten the lengthening bolt to the hammerhead by screwing or welding.

Furthermore, the mass of the moving blade may be further reduced if mass-reducing recesses are provided in the blade root.

Preferably, the recesses extend over the hammerhead and the lengthening bolt.

Although preferably running in the circumferential direction, these recesses may also extend in another, for example radial direction.

In a refinement of the rotor according to the invention, an interspace remains free between the lower end of the lengthening bolt and the bottom of the widened bottom region, and the free interspace has arranged in it a spring which presses the moving blade with the blade root against the radial stop faces in the radial direction.

In another refinement, the hammerhead has a predetermined height, the lengthening bolt has a predetermined radial length, and the ratio of height to length is between 0.2 and 0.8, that is to say $0.2<d_2/d_1<0.8$.

A further refinement is distinguished in that the hammerhead has a predetermined first axial width, in that the lengthening bolt has a predetermined second axial width, and in that the ratio of the second to the first axial width is between 0.2 and 0.6, that is to say $0.2<d_4/d_3<0.6$.

DETAILED DESCRIPTION

Figure 2:
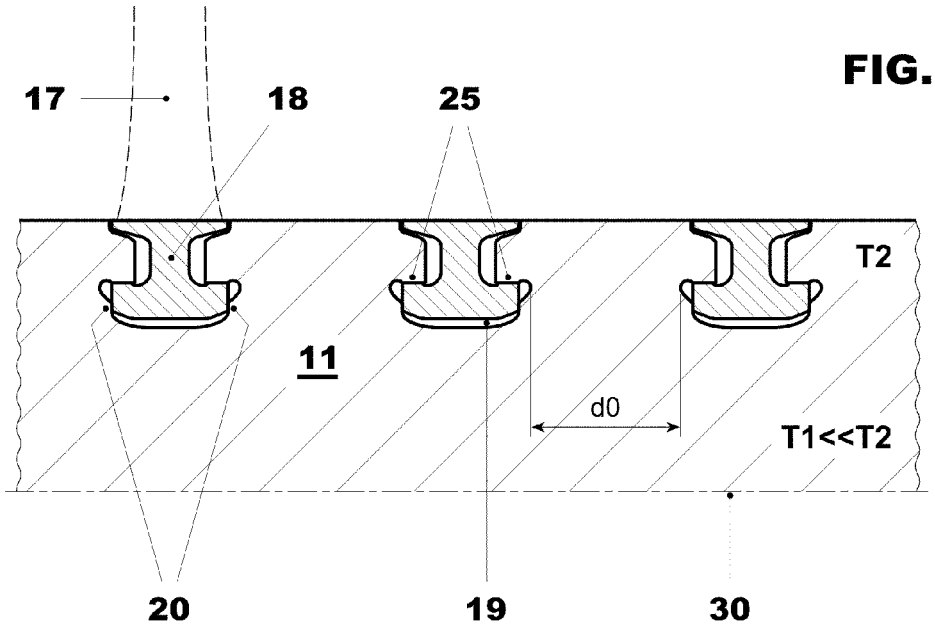
FIG. 2 shows the longitudinal section through the rotor of a known gas turbine in the region of the last stages of the compressor with the associated fastening of the moving blades.
Figure 4:
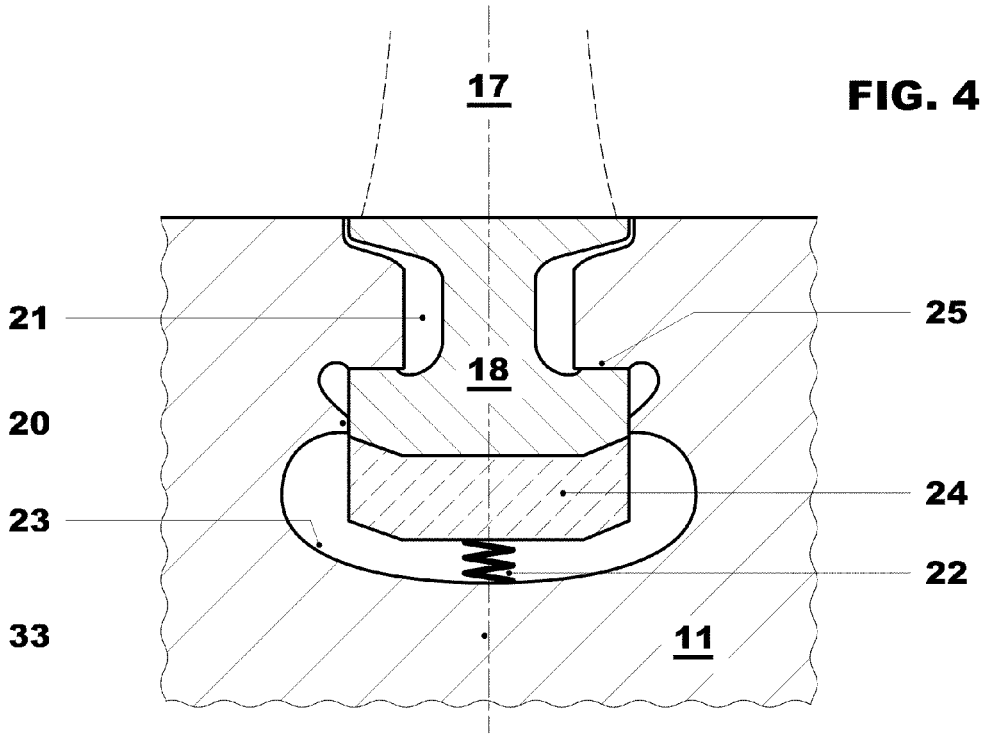
FIG. 4 shows a possible adaptation of the blade root to the modified rotor groove geometry.

FIG. 4 shows the longitudinal section, comparable to FIG. 2, through the rotor 11 of a gas turbine in the region of the last stages of the compressor according to the invention. A comparison of FIGS. 2 and 4 shows that the upper portion of the rotor groove 21 remains unchanged, as compared with the known rotor groove geometry from FIG. 2. The radial and axial stop faces 25 and 20 correspondingly remain virtually unchanged. Consequently, the proven design can be adopted in this region.

What is novel, however, is the widened bottom region 23 of the rotor groove 21. In the widened bottom region, a cross-sectional contour of the bottom region 23 is continuously curved, and the radius of curvature of the cross-sectional contour of the bottom region 23 is very large in the region of the mid-plane and decreases sharply from the mid-plane towards the margin. The cross-sectional contour is mirror-symmetrical to the mid-plane.

Figure 3:
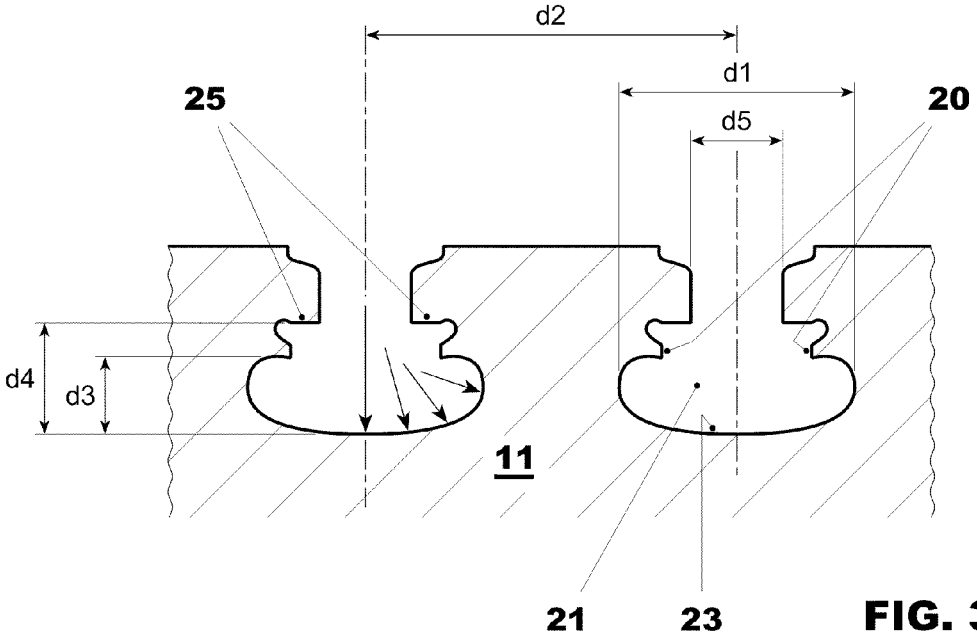
FIG. 3 shows two adjacent identical rotor grooves with a widened bottom region and a continuously curved cross-sectional contour in an enlarged illustration with the associated dimensions.

The widened bottom region 23 widens directly below the axial stop faces 20, on both sides, in the axial direction in the manner of a relief. It has, as shown in FIG. 3, a predetermined maximum width $d_1$ in the axial direction, while the radial stop faces 25 have a predetermined minimum spacing $d_5$ in the axial direction. It is especially beneficial if the ratio of the minimum spacing $d_5$ to the maximum width $d_1$ amounts to between 0.1 and 0.6, that is to say the inequality $0.1<d_5/d_1<0.6$ is true.

The widened bottom region 23 has a predetermined first maximum depth $d_4$ in relation to the radial stop faces 25. It has a predetermined second maximum depth $d_3$ in relation to the inner edges of the axial stop faces 20. It is especially beneficial if the ratio of the second maximum depth $d_3$ to the first maximum depth $d_4$ amounts to between 0.4 and 0.9, that is to say if the inequality $0.4<d_3/d_4<0.9$ is true.

A further inequality relates to the offset of the rotor grooves with respect to one another. If a plurality of identical rotor grooves 21 are provided, offset at a predetermined distance $d_2$ with respect to one another, in the axial direction, it is advantageous if the ratio of the maximum width $d_1$ to the distance $d_2$ amounts to between 0.5 and 0.8, that is to say the inequality $0.5<d_1/d_2<0.8$ is true.

Basically, the previous moving blades with their blade roots 18 can be taken over unchanged and used in the widened rotor grooves 21. However, because of the widened bottom region 23, the blade root 18 would then have to be provided with an additional volume 24, as shown in FIG. 4, which would lead to undesirable secondary effects.

Figure 5:
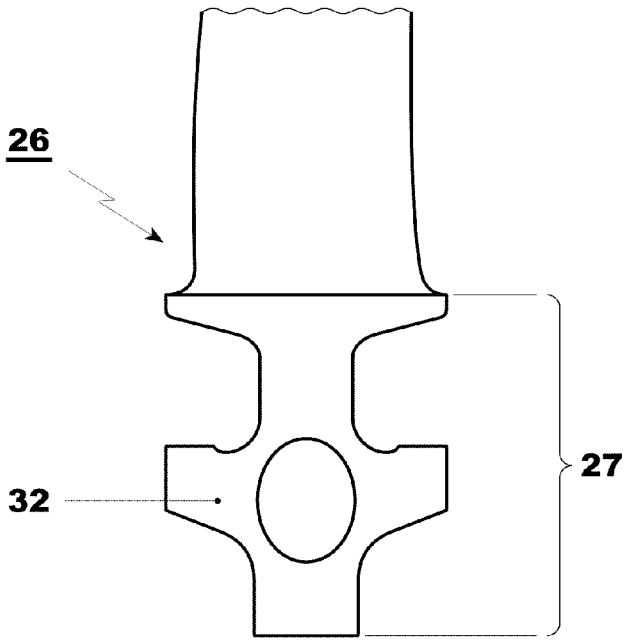
FIG. 5 shows the illustration of an adapted moving blade for the changed rotor groove geometry from FIG. 3 according to an exemplary embodiment of the invention.
Figure 6:
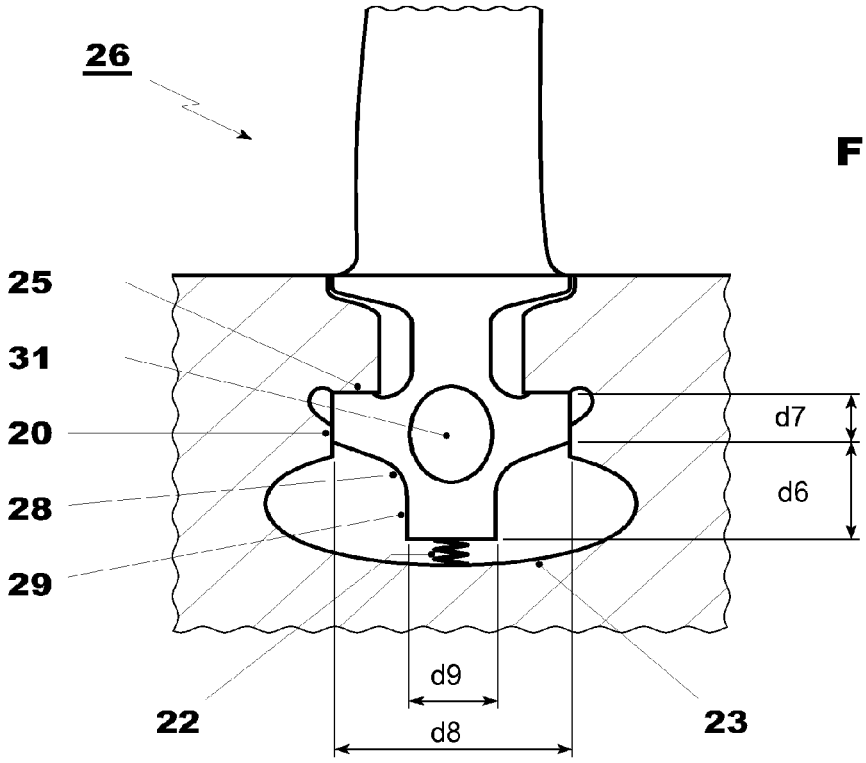
FIG. 6 shows the adapted moving blade from FIG. 5 inserted into the rotor groove from FIG. 3.
Figure 7:
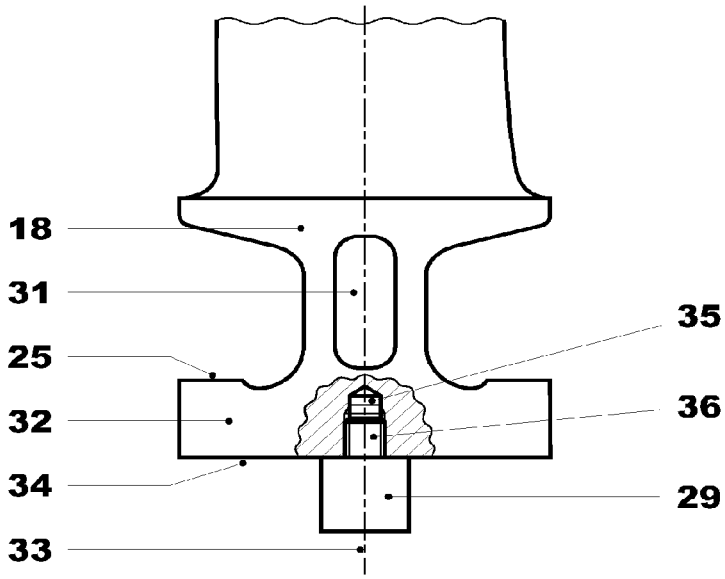
FIG. 7 shows an illustration of an adapted moving blade for the changed rotor groove geometry from FIG. 3 in a type of design alternative to that of FIG. 5.

An adaptation of the blade root to the changed rotor groove geometry is therefore preferred, this being reproduced by way of example in FIGS. 5, 6 and 7. The moving blade 26 of FIGS. 5 and 6 has a blade root 27 which in the upper portion, which reaches as far as the axial stop faces, is designed in essentially the same way as the blade root 18 from FIG. 2. However, by contrast differs in the radial downward prolongation, starting at the hammerhead 32, by means of a lengthening bolt 29 which is integrally formed onto the hammerhead 32 and which is narrower (width $d_9$) than the hammerhead 32 (width $d_8$). The radial length ($d_6$) of the lengthening bolt (29) is markedly greater than the height ($d_7$) of the hammerhead 32.

If the lengthening bolt 29 is integrally formed directly on the hammerhead 32, a curved transitional face 28 is preferably provided at a transition between the lengthening bolt 29 and the hammerhead 32 in order to ensure a continuous transition.

As a cost-effective alternative for the axial lengthening of the blade root 18, it is appropriate to produce the lengthening bolt 29 as a separate part and to connect it to the hammerhead 32. Screwing or welding has in this case proved to be a method of connection which satisfies the requirements of practical operation. Thus, the hammerhead 32 may be equipped on the bottom 34, in the region of the mid-plane 33, with a threaded bore 35. With the aid of an integrally formed threaded bolt 36, the lengthening bolt 29 is screwed into the blade root 18, as outlined by way of example in FIG. 7.

Furthermore, one or more mass-reducing recesses 31 are provided in the blade root 18, 27 and may be designed as a circular, elliptical or otherwise shaped hole or slot in a single or multiple version. The recess or recesses 31 extends or extend in the radial direction preferably over the hammerhead 32 and the lengthening bolt 29. In this case, this recess or these recesses 31 preferably, but not necessarily, runs or run in the circumferential direction, as illustrated in FIGS. 5, 6 and 7. Other suitable directional runs and embodiments of mass-reducing recesses 31 may likewise be envisaged, however, such as, for example, in the form of bores introduced radially into the blade root 27.

The ratio of the height ($d_7$) of the hammerhead 32 to the length ($d_6$) of the lengthening bolt 29 is preferably between 0.2 and 0.8, that is to say the inequality $0.2<d_7/d_6<0.8$ is applicable.

The ratio of the axial width ($d_9$) of the lengthening bolt 29 to the axial width ($d_8$) of the hammerhead 32 is preferably between 0.2 and 0.6, that is to say the inequality $0.2<d_9/d_8<0.6$ is applicable.

The invention includes the following features and advantages: The blade root comprises as a radial prolongation a lengthening bolt having the dimensions $0.2<d_7/d_6<0.8$ and $0.2<d_9/d_8<0.6$, so that the spring 22 can be used for assembly. The lengthening bolt 29 may be chamfered at the margins in order to save additional weight. The transitional faces between the lengthening bolt and the hammerhead are preferably curved in order to reduce mechanical stresses. In the region of the hammerhead and of the lengthening bolt, recesses, in particular holes or slots are provided, in order to reduce the weight or mass.

LIST OF REFERENCE SYMBOLS

10 Gas turbine
11 Rotor
12 Compressor
12*a* Last compressor stages
13*a*, 13*b* Turbine (HP, LP)
14*a*, 14*b* Combustion chamber
15 Air inlet
16 Exhaust gas outlet
17, 26 Moving blade, moving blade leaf
18, 27 Blade root
19, 21 Rotor groove
20 Stop face (axial)
22 Spring
23 Bottom region (widened)
24 Additional volume
25 Stop face (radial)
28 Transitional face (curved)
29 Lengthening bolt
30 Rotor axis
31 Recess
32 Hammerhead
33 Mid-plane
34 Blade root bottom
35 Threaded bore
36 Threaded bolt
$d_1, \ldots, d_4$ Distance

What is claimed is:

1. A rotor for an axial-throughflow turbomachine, the rotor carries a plurality of moving blades which are pushed, in each case, with a blade root into a rotor groove extending about an axis and are held there, with the blade root comprising a hammer root with a hammerhead and being supported on radial stop faces of the rotor groove which lie further out in the radial direction, against centrifugal forces which act on the plurality of moving blades, and being supported on axial stop faces lying further inward in the radial direction, against axial forces which act on the plurality of moving blades, the rotor groove having at a bottom portion, in order to reduce thermal stresses, an axially and radially widened bottom region with a continuously curved cross-sectional contour, wherein the bottom region radially extends beyond a lowermost stop face, and the bottom region is axially widened beyond the radial and axial stop faces, the blade root of the plurality of moving blades is adapted to the widened bottom region in a radial direction; and wherein the widened bottom region has a predetermined maximum width ($d_1$) in an axial direction, the radial stop faces have a predetermined minimum distance ($d_5$) in the axial direction, and a ratio of the minimum distance ($d_5$) to the maximum width ($d_1$) is between 0.1 and 0.6, namely $0.1<d_5/d_1<0.6$ the widened bottom region has a predetermined first maximum depth ($d_4$) in relation to the radial stop faces, the widened bottom region has a predetermined second maximum depth ($d_3$) in relation to inner edges of the axial stop faces, and a ratio of the second maximum depth ($d_3$) to the first maximum depth ($d_4$) is between 0.4 and 0.9, namely $0.4<d_3/d_4<0.9$.

2. The rotor as claimed in claim 1, wherein the widened bottom region is formed mirror-symmetrically to a mid-plane passing through the rotor groove and standing perpendicularly to the axis, and a radius of curvature of the cross-sectional contour of the bottom region increases from the mid-plane towards the margin.

3. The rotor as claimed in claim 1, wherein a plurality of identical rotor grooves are provided, offset at a predetermined distance ($d_2$), in the axial direction, and a ratio of the maximum width ($d_1$) to the distance ($d_2$) is between 0.5 and 0.8, namely $0.5<d_1/d_2<0.8$.

4. The rotor as claimed in claim 1, wherein a lengthening bolt extending in the radial direction is integrally formed onto the blade root below the hammerhead in order to bridge the radial widening of the widened bottom region.

5. The rotor as claimed in claim 4, wherein an interspace remains free between a lower end of the lengthening bolt and the bottom of the widened bottom region, and the free interspace has arranged in it a spring which presses the moving blade with the blade root against the radial stop faces in the radial direction.

6. A moving blade for a rotor as claimed in claim 1, the moving blade comprising a blade root designed as a hammer root with a hammerhead the blade root is extended in the radial direction below the hammerhead in order to bridge the radial widening of the widened bottom region of the rotor groove.

7. The moving blade as claimed in claim 6, wherein a lengthening bolt extending radially is provided for lengthening the blade root.

8. The moving blade as claimed in claim 7, wherein the lengthening bolt is integrally formed on the hammerhead.

9. The moving blade as claimed in claim 7, wherein a curved transitional face is provided at a transition between the lengthening bolt and the hammerhead in order to ensure a continuous transition.

10. The moving blade as claimed in claim 7, wherein the lengthening bolt is produced as a separate part and is connected to the hammerhead.

11. The moving blade as claimed in claim 10, wherein the lengthening bolt is screwed onto the hammerhead.

12. The moving blade as claimed in claim 10, wherein the lengthening bolt is welded to the hammerhead.

13. The moving blade as claimed in claim 6, further comprising mass-reducing recesses provided in the blade root.

14. The moving blade as claimed in claim 13, wherein the recesses extend over the hammerhead and the lengthening bolt.

15. The moving blade as claimed in claim 13, wherein the recesses extend in a circumferential direction.

16. The moving blade as claimed in claim 13, wherein the recesses extend in a radial direction.

17. A rotor for an axial-throughflow turbomachine, the rotor carries a plurality of moving blades which are pushed, in each case, with a blade root into a rotor groove extending about an axis and are held there, with the blade root comprising a hammer root with a hammerhead and being supported on radial stop faces of the rotor groove which lie further out in the radial direction, against centrifugal forces which act on the plurality of moving blades, and being supported on axial stop faces lying further inward in the radial direction, against axial forces which act on the plurality of moving blades, the rotor groove having at a bottom portion, in order to reduce thermal stresses, an axially and radially widened bottom region with a continuously curved cross-sectional contour, wherein the bottom region radially extends beyond a lowermost stop face, and the bottom region is axially widened beyond the radial and axial stop faces, the blade root of the plurality of moving blades is adapted to the widened bottom region in a radial direction;

wherein a lengthening bolt extending in the radial direction is integrally formed onto the blade root below the hammerhead in order to bridge the radial widening of the widened bottom region; and wherein the hammerhead has a predetermined height ($d_7$), the lengthening bolt has a predetermined radial length ($d_6$), and the ratio of height to length ($d_7/d_6$) is between 0.2 and 0.8, namely $0.2<d_7/d_6<0.8$, the hammerhead has a predetermined first axial width ($d_8$), the lengthening bolt has a predetermined second axial width ($d_9$), and a ratio of the second to the first axial width ($d_9/d_8$) is between 0.2 and 0.6, namely $0.2<d_9/d_8<0.6$.

18. A rotor for an axial-throughflow turbomachine, the rotor carries a plurality of moving blades which are pushed, in each case, with a blade root into a rotor groove extending about an axis and are held there, with the blade root comprising a hammer root with a hammerhead and being supported on radial stop faces of the rotor groove which lie further out in the radial direction, against centrifugal forces which act on the plurality of moving blades, and being supported on axial stop faces lying further inward in the radial direction, against axial forces which act on the plurality of moving blades, the rotor groove having at a bottom portion, in order to reduce thermal stresses, an axially and radially widened bottom region with a continuously curved cross-sectional contour, wherein the bottom region radially extends beyond a lowermost stop face, and the bottom region is axially widened beyond the radial and axial stop faces, the blade root of the plurality of moving blades is adapted to the widened bottom region in a radial direction;

the moving blade comprising a blade root designed as a hammer root with a hammerhead, the blade root is extended in the radial direction below the hammerhead in order to bridge the radial widening of the widened bottom region of the rotor groove;

wherein a lengthening bolt extending radially is provided for lengthening the blade root; and wherein the hammerhead has a predetermined height ($d_7$), the lengthening bolt has a predetermined radial length ($d_6$), and a ratio of height to length ($d_7/d_6$) is between 0.2 and 0.8, namely $0.2<d_7/d_6<0.8$.

19. The moving blade as claimed in claim 18, wherein the hammerhead has a predetermined first axial width ($d_8$), the lengthening bolt has a predetermined second axial width ($d_9$) and a ratio of the second to the first axial width ($d_9/d_8$) is between 0.2 and 0.6, namely $0.2<d_9/d_8<0.6$.

* * * * *